US010376430B2

(12) United States Patent
Liu

(10) Patent No.: US 10,376,430 B2
(45) Date of Patent: Aug. 13, 2019

(54) INFLATABLE STRETCHER

(71) Applicant: CAREMED SUPPLY INC., New Taipei (TW)

(72) Inventor: Tsung Hsuan Liu, Taipei (TW)

(73) Assignee: CAREMED SUPPLY INC., New Taipei (TW)

( * ) Notice: Subject to any disclaimer, the term of this patent is extended or adjusted under 35 U.S.C. 154(b) by 0 days.

(21) Appl. No.: 15/671,786

(22) Filed: Aug. 8, 2017

(65) Prior Publication Data

US 2019/0046371 A1 Feb. 14, 2019

(51) Int. Cl.

| | |
|---|---|
| ***A47C 27/08*** | (2006.01) |
| ***A61G 7/057*** | (2006.01) |
| ***A61G 7/10*** | (2006.01) |
| ***A61G 7/00*** | (2006.01) |
| ***A61G 7/14*** | (2006.01) |
| ***A47C 27/10*** | (2006.01) |
| ***A47C 17/00*** | (2006.01) |
| ***A61G 1/013*** | (2006.01) |

(52) U.S. Cl.

CPC ..... *A61G 1/013* (2013.01); *A47C 27/081* (2013.01); *A47C 27/10* (2013.01); *A61G 7/10* (2013.01)

(58) Field of Classification Search

CPC .... A61G 1/013; A61G 1/044; A61G 1/05746; A61G 7/05769; A61G 7/1021; A61G 13/1265; A61G 13/1275; A61G 7/057; A61G 7/10; A61G 7/00; A61G 7/14; A47C 27/08; A47C 27/081; A47C 27/083; A47C 27/082; A47C 27/084; A47C 27/10; A47C 17/00

See application file for complete search history.

(56) References Cited

U.S. PATENT DOCUMENTS

| | | | | |
|---|---|---|---|---|
| 6,073,291 | A * | 6/2000 | Davis | A61B 6/0485 414/676 |
| 7,028,350 | B1 * | 4/2006 | Davis | A61G 7/1021 297/452.41 |
| 7,735,164 | B1 * | 6/2010 | Patrick | A61G 7/1021 5/710 |
| 2007/0072690 | A1 * | 3/2007 | Berenson | A63G 21/00 472/117 |
| 2012/0124752 | A1 * | 5/2012 | Patrick | A61G 1/02 5/703 |
| 2013/0042414 | A1 * | 2/2013 | Schreiber | A61G 7/05 5/714 |
| 2017/0049646 | A1 * | 2/2017 | Rigoni | A61G 7/05715 |

* cited by examiner

*Primary Examiner* — Eric J Kurilla
*Assistant Examiner* — Rahib T Zaman
(74) *Attorney, Agent, or Firm* — Rabin & Berdo, P.C.

(57) ABSTRACT

An inflatable stretcher for carrying and conveniently transferring a patient to another patient carrying device includes an air mattress having an upper sheet member and a longitudinally perforated lower sheet member, which are fixedly connected to each other along their peripheral edges to form an inflatable air bag. The air mattress has at least one air inlet, via which an air hose is communicably connected to the air bag. The air mattress includes at least one limiting member located in the vicinity of the air inlet. The limiting member defines a binding space, which is changeable in size to correspond to a size of the air hose, such that the limiting member can always be fitly set or wrapped around the air hose to hold the air hose to the air mattress even if the air hose has a specification not matching the air inlet on the air mattress.

4 Claims, 19 Drawing Sheets

INFLATABLE STRETCHER

FIELD OF THE INVENTION

The present invention relates to an inflatable stretcher, and more particularly, to an inflatable stretcher that includes a limiting member to always securely hold an air hose of an inflating device to the inflatable stretcher.

BACKGROUND OF THE INVENTION

Air mattresses are very common bedding items in the medical care field and can be differently designed according to different applications. Among others, there is an inflatable stretcher that includes an air mattress having a plurality of perforations formed on a bottom thereof. Air inside the air mattress can jet out of the air mattress via the perforations to reduce the friction between the air mattress and a supporting surface, such as the ground surface, so that the inflatable stretcher can be more easily moved to transport the patient lying thereon.

FIG. 1 shows a conventional inflatable stretcher, which mainly includes an air mattress 01, at least one air hose 02 and an inflating device 03, such as a motor, a pump or the like. The inflating device 03 is connected to the air mattress 01 via the air hose 02 for supplying air into the air mattress 01 to inflate the same. As can be seen in FIG. 1, the air hose 02 is connected to the air mattress 01 by directly inserting an end of the air hose 02 into an opening 04 provided on the air mattress 01. There is not any other holding device provided at the opening 04 for securely holding the air mattress 01 and the air hose 02 to one another. When the above-described conventional inflatable stretcher is in use, it is very often the air mattress 01 is moved by an operator relative to the air hose 02. At this point, the only means that keeps the air hose 02 connected to the air mattress 01 is the coupling design between the air hose 02 and the opening 04.

To prevent the air hose 02 from separating from the air mattress 01 due to a movement of the air mattress 01 relative to the air hose 02 or due to the continuous change of air pressure inside the air hose 02, and to maintain an airtight coupling of the air hose 02 to the air mattress 01, most conventional inflatable stretchers have to use an air hose 02 that is sized to match the opening 04 provided on the air mattress 01, so that the air hose 02 can be fitly engaged with the opening 04. Or, a connector for correspondingly connecting the air hose 02 to the opening 04 is designed and used to stop them from separating from each other. Or, some kind of fastening device is provided on the air hose 02 for fastening to the air mattress 01, so that the air hose 02 won't become separated from the air mattress 01 due to any movement of the inflatable stretcher.

However, with all the above coupling designs, the air hose and the opening on the air mattress or the coupling mechanisms provided between them must always match in size. That is, the air hose and the coupling mechanisms could not be freely replaced with other differently sized air hoses or coupling mechanisms, which causes inconvenience in repairing or maintaining the conventional inflatable stretcher. Further, being restricted to use with only the air hose of a predetermined specification, the air mattress and the inflating device are also not freely replaceable with other functionally improved ones to meet actual need in use.

SUMMARY OF THE INVENTION

A primary object of the present invention is to provide an inflatable stretcher, with which it is not necessary for an air hose for inflating the inflatable stretcher to be a type or have a size absolutely matching an air inlet on the inflatable stretcher. In other words, the air hose connected to the air inlet for inflating the inflatable stretcher is not limited to any particular specification.

Another object of the present invention is to provide an inflatable stretcher that includes a limiting member for connecting an air hose to an air mattress of the inflatable stretcher, and the limiting member exerts an even increased binding force against the air hose when a relative movement between the air mattress and the air hose occurs.

A further object of the present invention is to provide an inflatable stretcher that includes a limiting member for connecting an air hose to an air mattress of the inflatable stretcher, and the limiting member can exert an even increased binding force against the air hose when a relative movement between the air mattress and the air hose occurs while the air hose need not to be provided with any special securing element corresponding to the limiting member.

To achieve the above and other objects, the inflatable stretcher according to the present invention is inflated via an air hose for carrying a patient thereon and conveniently transferring the patient to another patient carrying device and includes an inflatable mattress having an upper sheet member and a lower sheet member, which are fixedly connected to each other along their peripheral edges to form an inflatable air bag. The air mattress is provided with at least one air inlet, via which the air hose is communicably connected to the air bag; and the lower sheet member has a plurality of perforations formed thereon and arranged lengthwise.

The inflatable stretcher of the present invention is characterized in that the air mattress includes at least one limiting member located in the vicinity of the air inlet. The limiting member is able to define a binding space, which is changeable in size to correspond to a size of the air hose, such that the limiting member can be always fitly set or wrapped around an outer surface of the air hose.

The limiting member for holding the air hose to the air mattress can be differently configured. In an operable embodiment of the present invention, the limiting member is configured as an elastic ring, which is disposed along and connected to a rim of the air inlet. The elastic ring normally defines a first binding space diametrically smaller than the air hose and is elastically expandable to define a second binding space diametrically larger than the air hose for the air hose to extend therethrough. And, the elastic ring automatically elastically reduces in size to define a third binding space corresponding to the size of the air hose when the elastic ring is fitted around the air hose. The size-changeable elastic ring can exert a force against the air hose to prevent the air hose from separating from the air mattress.

According to another operable embodiment of the present invention, the limiting member is configured as a cord having two ends connected to a position on the air mattress in the vicinity of the air inlet to form a tie ring that defines the binding space. The tie ring has a cord lock mounted thereon, and the cord lock is movable along an extension direction of the tie ring to be selectively locked to any position on the tie ring for adjusting the binding space to a size corresponding to that of the air hose, so that the cord can bind the air hose thereto.

In some cases of using the limiting member, it might be necessary to further enhance the binding force exerted by the limiting member against the air hose. For this purpose, the limiting member according to some operable embodiments of the present invention is configured as a cord or a belt.

When the air hose is pulled and moved from an initial position relative to the air mattress, the limiting member connected to between the air hose and the air mattress will also be pulled due to the relative movement between the air hose and the air mattress and produce a tension that resists the relative movement. The increased tension in the limiting member causes the section of the limiting member that is wound around the air hose to exert a force toward the binding space and more tightly hold the air hose thereto.

In one of the above operable embodiments, the limiting member is configured as a cord, which is outward extended from the air mattress in a direction in which the air inlet is oriented. The cord has a proximal end connected to the air mattress and a distal end provided with a ferrule. The proximal end of the cord is extended through the ferrule to form a tie ring on the cord for fitting around the air hose, and the tie ring defines the binding space. The binding space defined by the tie ring is adjustable to a size corresponding to that of the air hose by shifting the ferrule along the cord.

In another one of the above operable embodiments, the limiting member is configured as a belt, which is outward extended from the air mattress in a direction in which the air inlet is oriented. The belt in an initial position is wound around the air hose to form a tie ring structure. A distal end of the belt is movable farther away from the air mattress when a relative movement occurred between the air mattress and the air hose causes an increased tension of the belt, bringing the tie ring structure to extend in a central axial direction thereof corresponding to a distance of the relative movement and an overall length of the belt to thereby form a helical structure, and the belt having an increased tension exerts a force toward a center of the helical structure.

In some operable embodiments of the present invention, the belt is connected at a proximal end to the air mattress and is provided at the distal end with a holding member that is connected to a fixing end of the air hose.

In some other operable embodiments of the present invention, the belt has a proximal end connected to the air mattress and is provided at the distal end with a connecting section, which is connected to a specific position on the belt. Areas of the belt located at two opposite lateral sides of the specific position are defined as a first section and a second section. The second section is wound around the air hose to form a locating ring that is in contact with the outer surface of the air hose.

In an operable embodiment of the present invention, the first section has a length smaller than that of the second section.

In summary, the present invention is characterized in that the air mattress includes at least one limiting member located in the vicinity of the air inlet; and the limiting member is able to define a binding space, which is changeable in size to correspond to a size of the air hose, such that the limiting member can always be fitly set or wrapped around an outer surface of the air hose that can be any type and size without the need to be specially designed or include any special securing element corresponding to the limiting member. That is, the limiting member according to the present invention can be used with air hoses of different sizes and specifications. In the embodiment the limiting member is configured as a belt having a proximal end connected to the air mattress, when the air hose and the air mattress are subjected to an external force and moved away from each other, the limiting member for holding the air hose to the air mattress is extended due to such movement to thereby have an increased tension. The belt with an increased tension exerts a stronger force against the air hose to more firmly hold the air hose to the air mattress.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
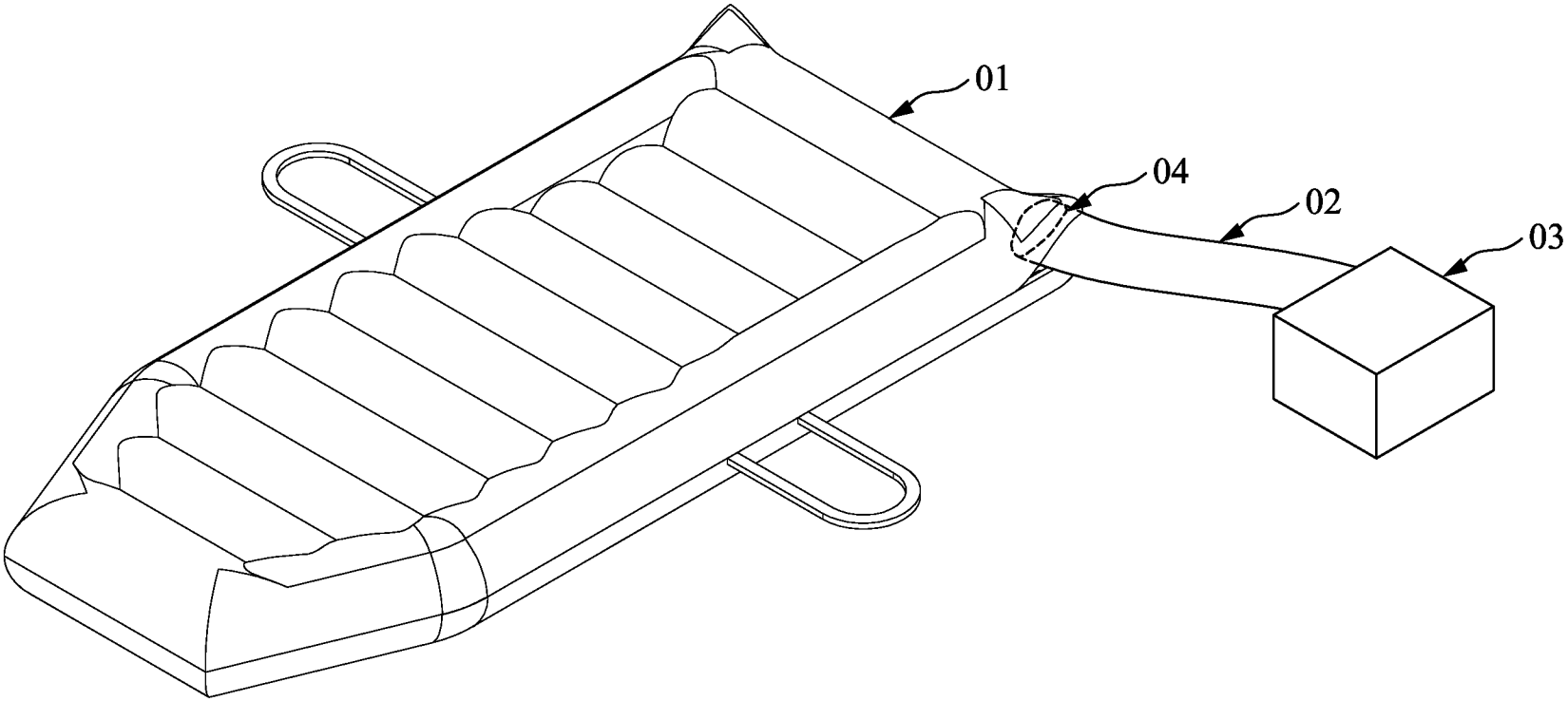
FIG. 1 (Prior Art)
FIG. 1 shows a conventional inflatable stretcher.

The present invention will now be described with some preferred embodiments thereof and by referring to the accompanying drawings. For the purpose of easy to understand, elements that are the same in the preferred embodiments are denoted by the same reference numerals.

Figure 2:
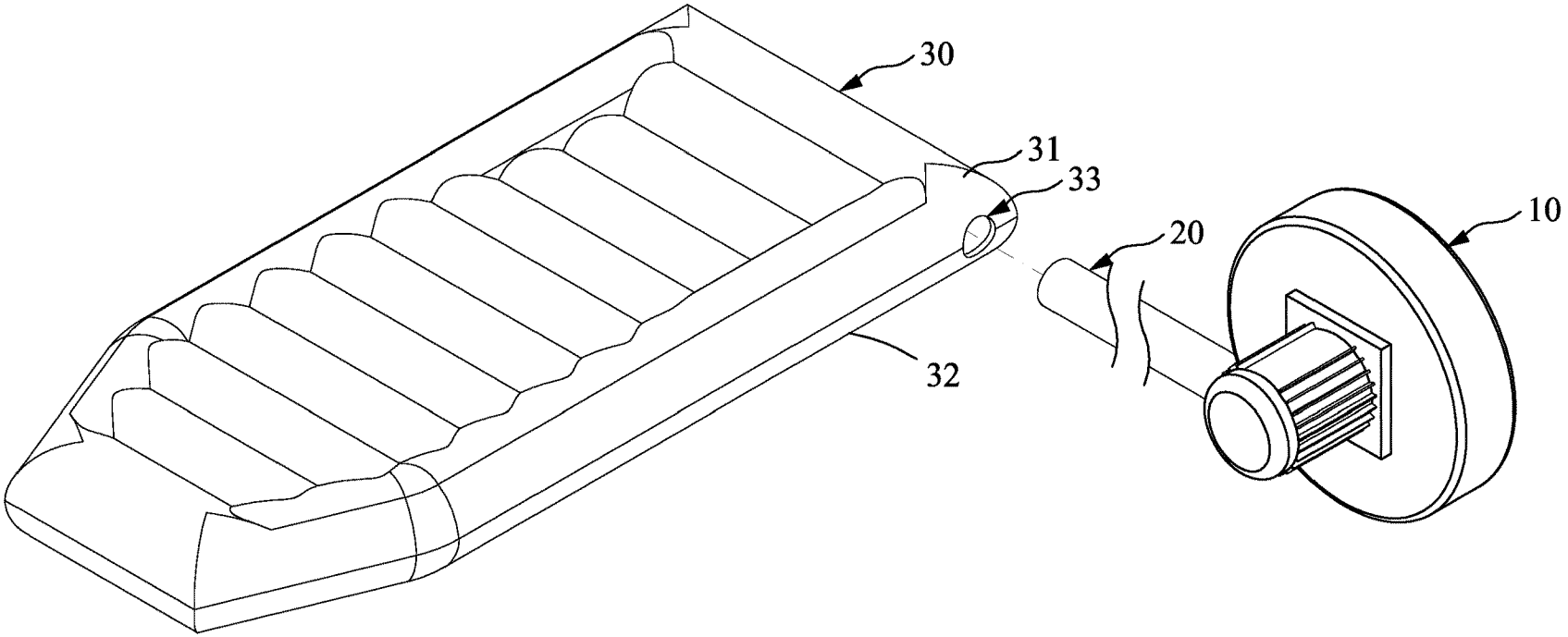
FIG. 2 is a perspective view of an inflatable stretcher according to the present invention.

Please refer to FIG. 2. An inflatable stretcher according to the present invention is inflated via at least one air hose 20, which is connected to an inflating device 10, for carrying a patient thereon and conveniently transferring the patient to another patient carrying or transporting device. The inflatable stretcher includes an air mattress 30 having an upper sheet member 31 and a lower sheet member 32, which are fixedly connected to each other along their peripheral edges to form an inflatable air bag (not shown) inside the air mattress 30. The air mattress 30 is provided with at least one air inlet 33, via which the air hose 20 is communicably connected to the inflatable air bag. Further, the lower sheet member 32 has a plurality of perforations (not shown) formed thereon and arranged lengthwise, such that air supplied from the inflating device 10 into the air bag leaves the air bag via the perforations on the lower sheet member 32 of the air mattress 30. With this arrangement, it is possible to reduce the frictional force between the air mattress 30 and a supporting surface, such as the ground surface, allowing operators to transport the patient with the inflatable stretcher in a more convenient manner.

The air mattress 30 includes at least one limiting member 35, which is located in the vicinity of the air inlet 33 for ensuring the connection of the air hose 20 to the air mattress 30. It is noted the limiting member 35 is not shown in FIG. 2 and, to enable convenient explanation of the present invention, the limiting member 35 shown in other figures is not in real proportion to other elements in the figures. The limiting member 35 is able to define a binding space 50, which is changeable in size to correspond to the size of the air hose 20, so that the limiting member 35 can always be fitly set or wrapped around an outer surface of the air hose 20. Also, the limiting member 35 can be differently configured according to actual need in use.

Figure 3A:
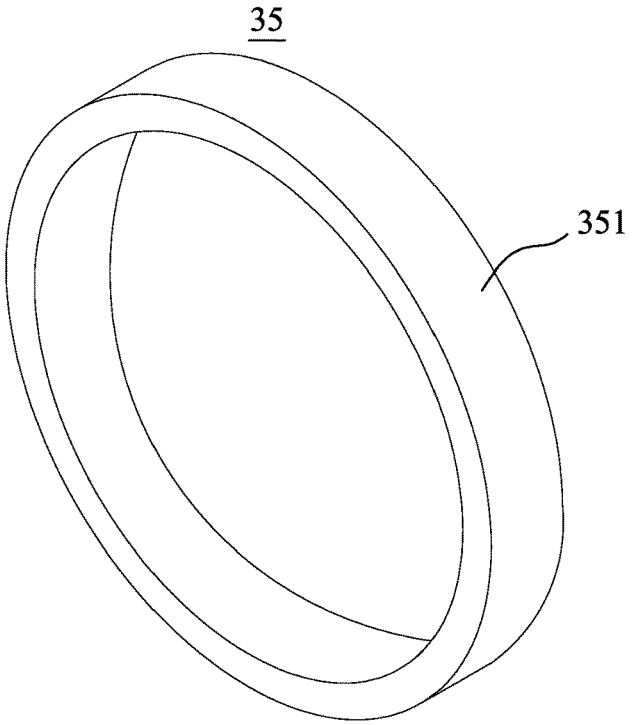
FIGS. 3A and 3B are perspective views showing a limiting member of the inflatable stretcher according to a first embodiment of the present invention for connecting an air mattress of the inflatable stretcher to an air hose.
Figure 3B:
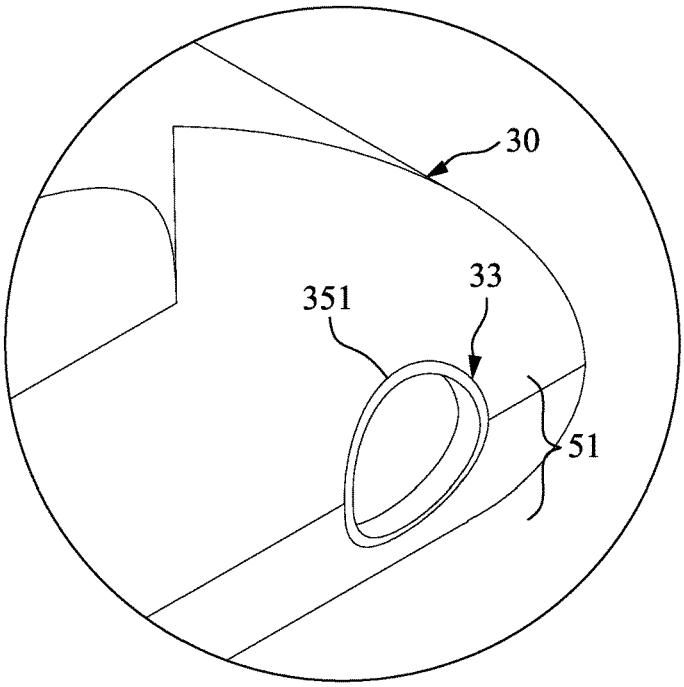
Figure 3C:
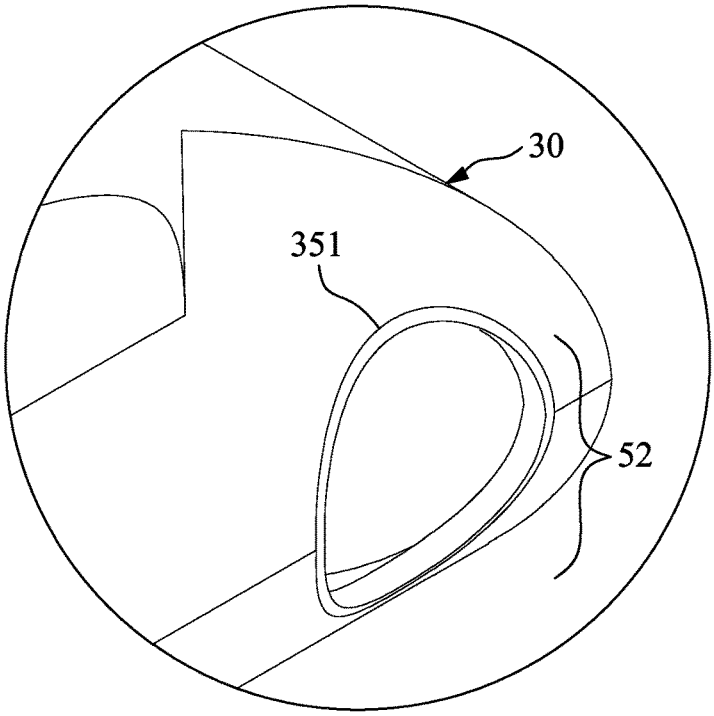
FIG. 3C shows the limiting member of FIG. 3B is ready for connecting the air mattress to the air hose.
Figure 3D:
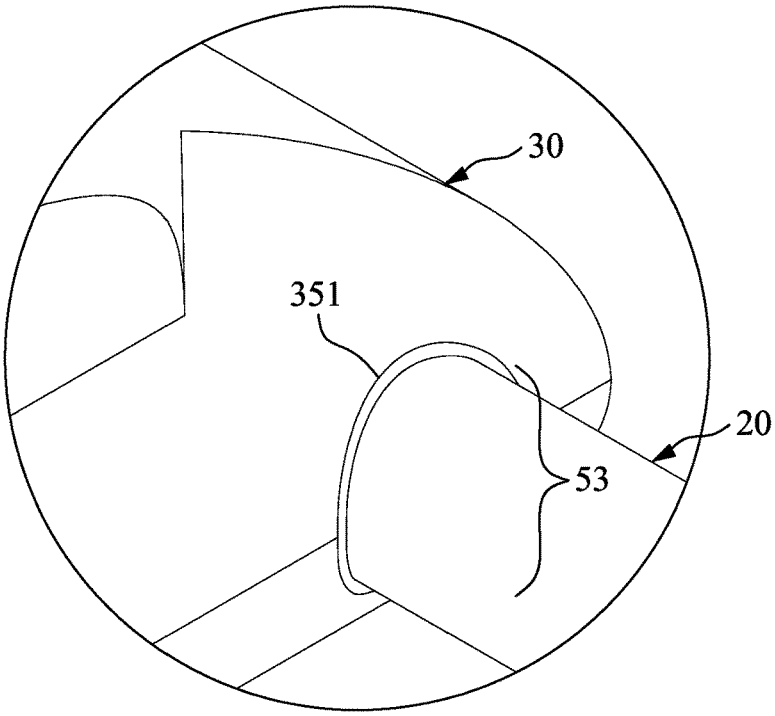
FIG. 3D shows the air mattress has been connected to the air hose via the limiting member of FIG. 3B.

Please refer to FIGS. 3A to 3D. According to a first embodiment of the present invention, the limiting member 35 is configured as an elastic ring 351, which is disposed along and connected to a rim of the air inlet 33, as shown in FIG. 3B. Before being connected to the air hose 20, the elastic ring 351 normally defines a first binding space 51 diametrically smaller than the air hose 20. Referring to FIG. 3C, to connect the air hose 20 to the air mattress 30 via the air inlet 33, the elastic ring 351 is first elastically expanded to define a second binding space 52 diametrically larger than the air hose 20. After the air hose 20 has been connected to the air mattress 30, the elastic ring 351 is allowed to automatically elastically reduce in size and define a third binding space 53 corresponding to the size of the air hose 20 for tightly fitting around the air hose 20, as shown in FIG. 3D. Therefore, by taking advantage of a force applied by the elastic ring 351 on a wall of the air hose 20 and a frictional force existing between the elastic ring 351 and the wall of the air hose 20, differently sized air hoses 20 can be selectively connected to the air mattress 30 via the elastic ring 351.

Figure 4A:
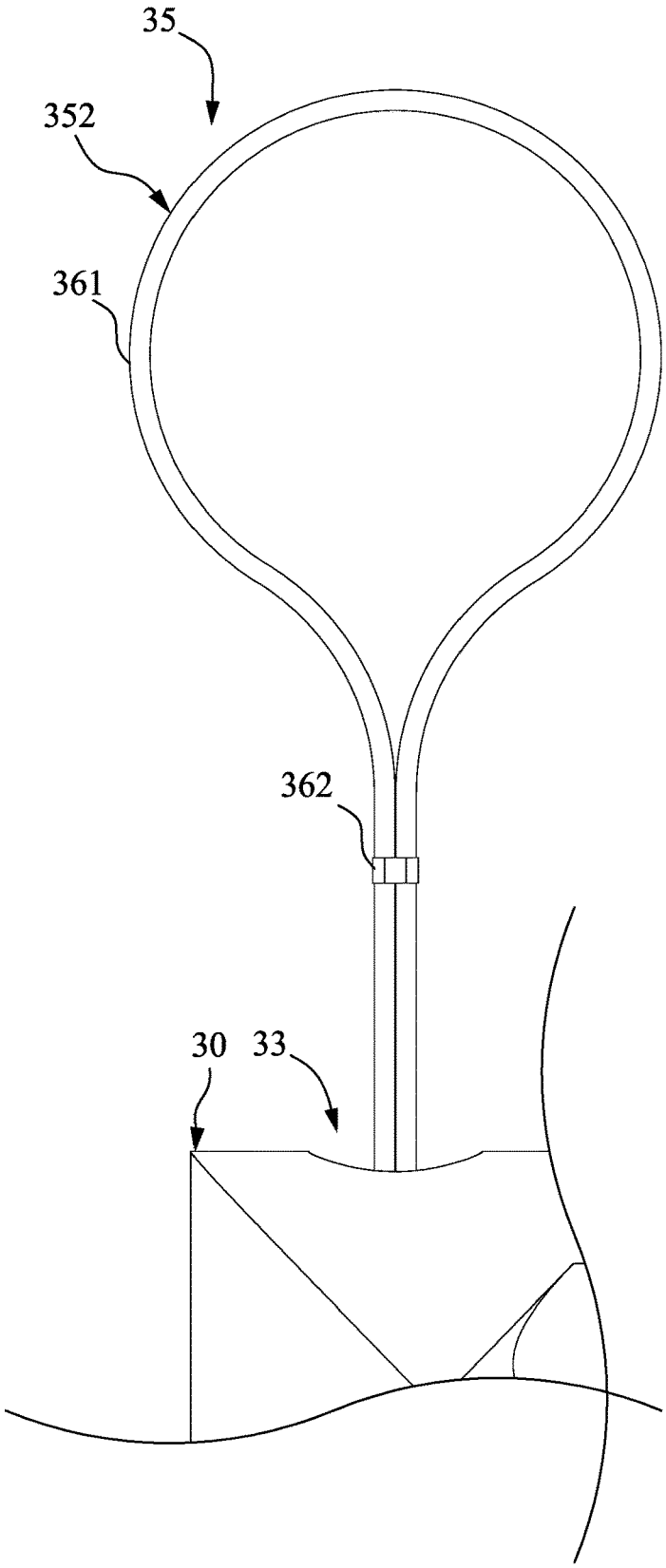
FIG. 4A shows a limiting member of the inflatable stretcher according to a second embodiment of the present invention.
Figure 4B:
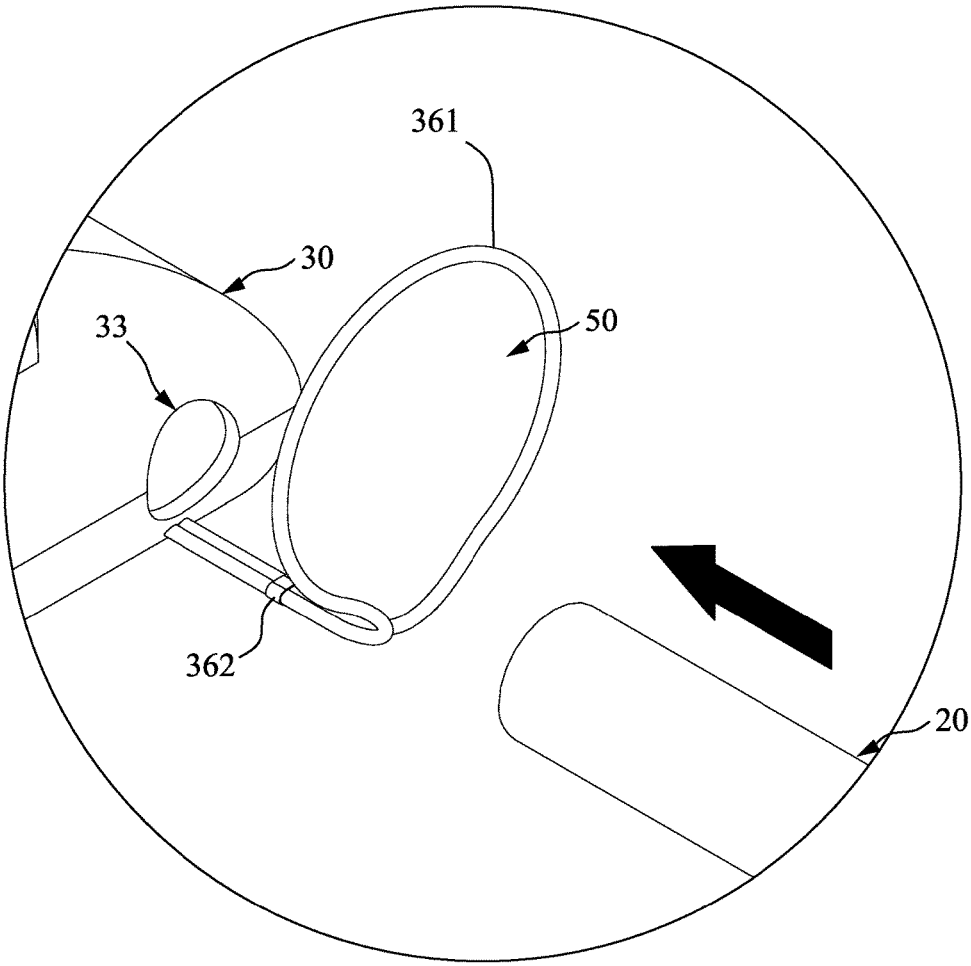
FIG. 4B shows the limiting member of FIG. 4A is ready for connecting the air mattress to the air hose.
Figure 4C:
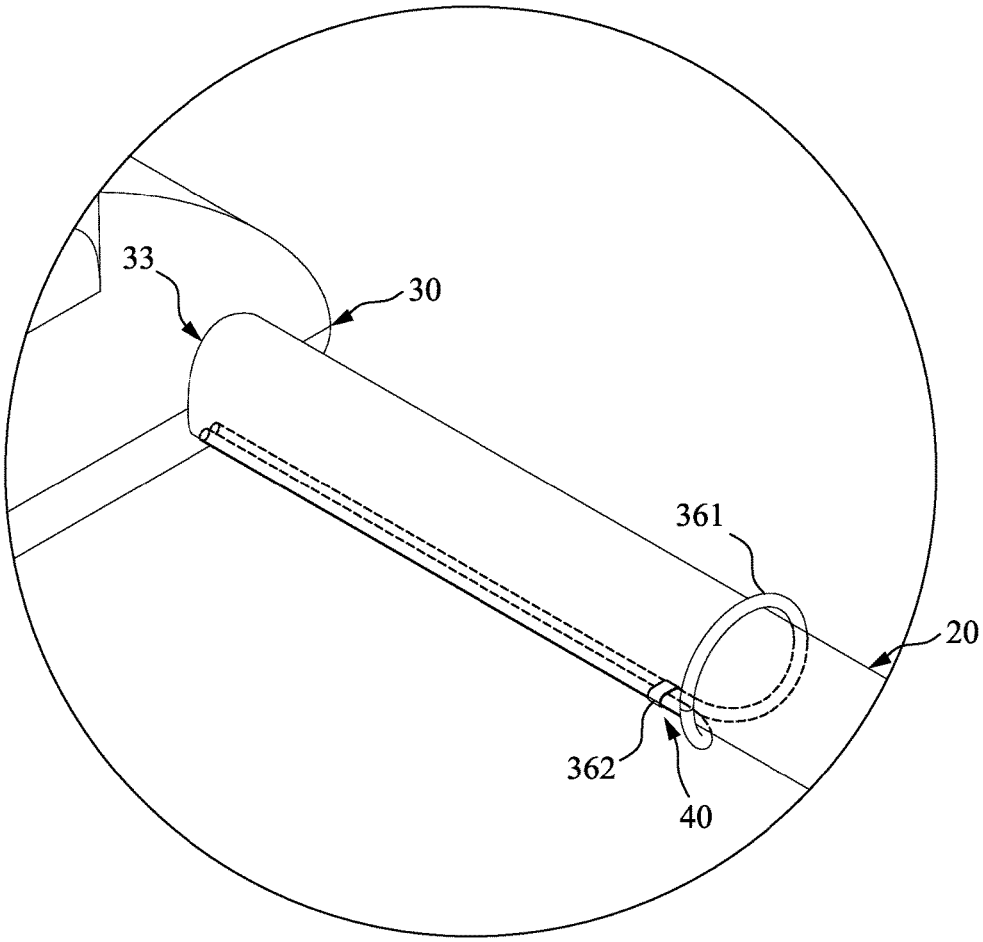
FIG. 4C shows the air mattress has been connected to the air hose via the limiting member of FIG. 4A and the limiting member is now in an initial position.

Please refer to FIGS. 4A to 4C. According to a second embodiment of the present invention, the limiting member 35 is configured as a cord 352, or more specifically, a tie cord, which has two ends connected to a position on the air mattress 30 in the vicinity of the air inlet 33 to form a first tie ring 361 that defines the binding space 50. A cord lock 362 is mounted on the first tie ring 361 and movable along an extension direction of the first tie ring 361 to be selectively locked to any position on the first tie ring 361.

To use the cord 352, as shown in FIGS. 4B and 4C, first move the cord lock 362 to a specific position 40 on the first tie ring 361, such that the binding space 50 is adjusted to a size corresponding to that of the air hose 20. Therefore, the first tie ring 361 can apply a force on the wall of the air hose 20, which can be differently sized, and take advantage of a frictional force between it and the air hose 20 to hold the air hose 20 to the air mattress 30.

In the above-described first and second embodiments of the present invention, once the limiting member 35 is connected to the air hose 20, the tightness and stability of the connection between them is determined because there is not any other mechanism allowing for subsequent adjustment of the connection. However, FIGS. 5A to 7D illustrate some other embodiments of the present invention, in which any relative movement 60 between the air mattress 30 and the air hose 20 connected to one another via the limiting member 35 will cause a change in tension 61 of the limiting member 35. In the case of causing an increase in the tension 61, the tense limiting member 35 will exert an additional binding force 62 toward the binding space 50 and accordingly, further prevents the air hose 20 from easily sliding relative to the limiting member 35. These embodiments will be described in more details below.

Please refer to FIGS. 5A to 5D. According to a third embodiment of the present invention, the limiting member 35 is configured as a cord 352, which is outward extended from the air mattress 30 in a direction in which an opening of the air inlet 33 is oriented. The cord 352 has a proximal end connected to the air mattress and a distal end provided with a ferrule 371. The proximal end of the cord 352 is extended through the ferrule 371 to form a second tie ring 372 on the cord 352. The second tie ring 372 defines the binding space 50.

Figure 5A:
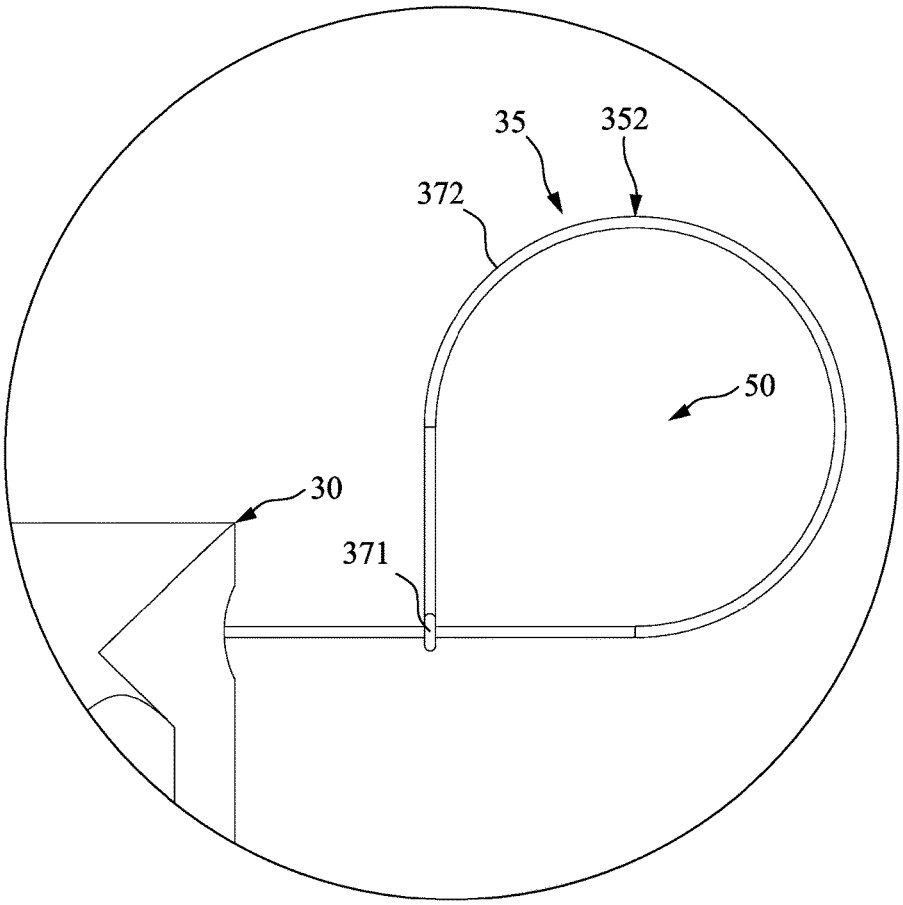
FIG. 5A shows a limiting member of the inflatable stretcher according to a third embodiment of the present invention.
Figure 5B:
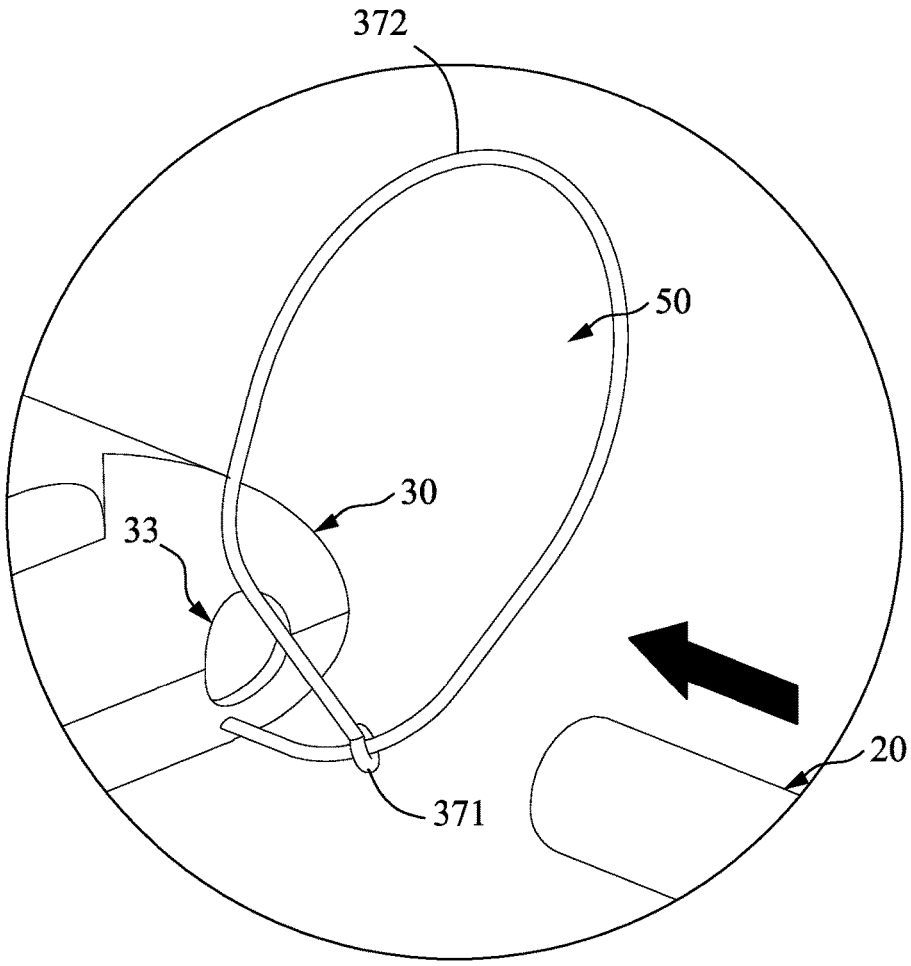
FIG. 5B shows the limiting member of FIG. 5A is ready for connecting the air mattress to the air hose.
Figure 5C:
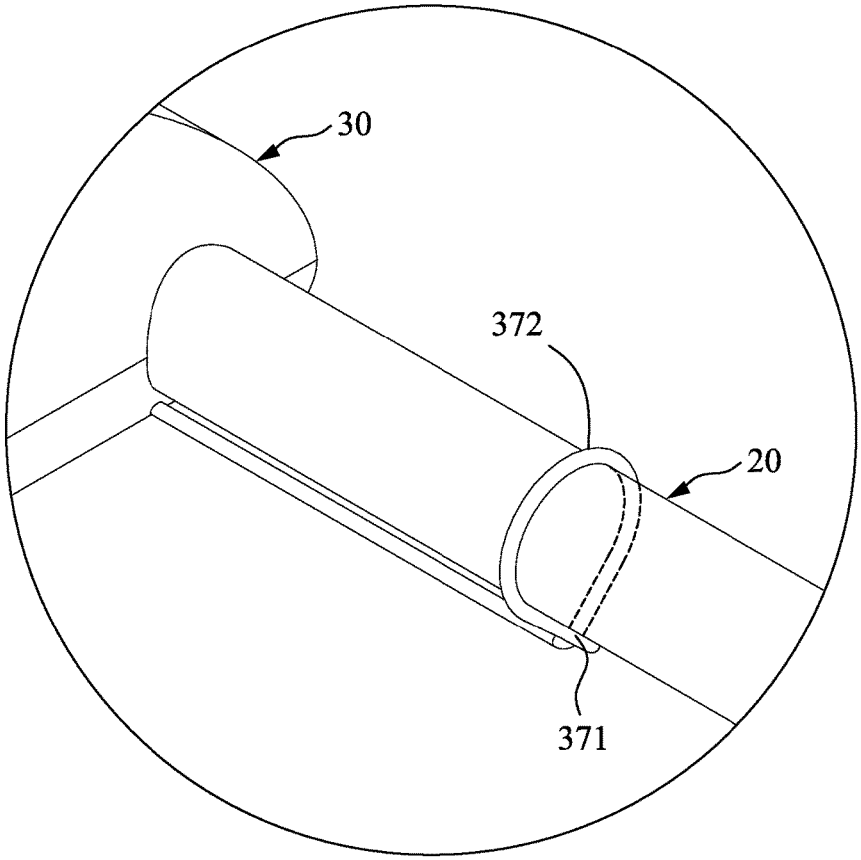
FIG. 5C shows the air mattress has been connected to the air hose via the limiting member of FIG. 5A and the limiting member is now in an initial position.
Figure 5D:
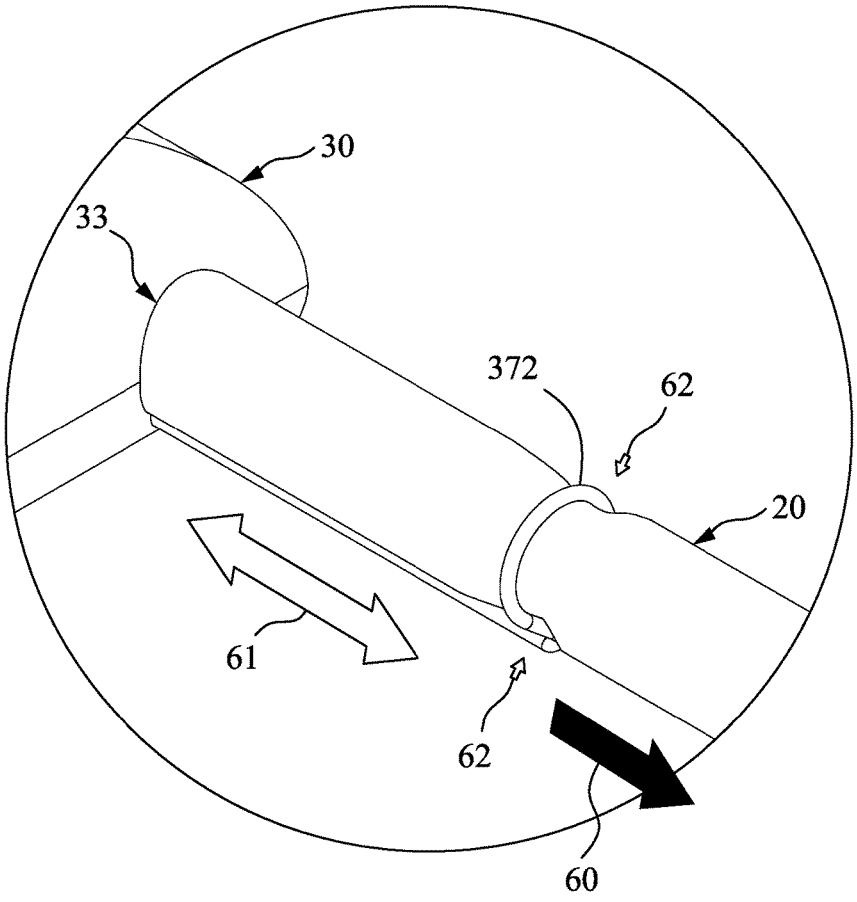
FIG. 5D shows a change in the tension of the limiting member of FIG. 5C when the air mattress is moved relative to the air hose.

Referring to FIGS. 5B and 5C. When the limiting member 35 is in an initial position, the second tie ring 372 is fitted around the air hose 20. The ferrule 371 can be shifted along the cord 352 to adjust the binding space 50 to a size corresponding to that of the air hose 20. When a relative movement 60 between the air hose 20 and the air mattress 30 occurs to cause an increased tension 61 in the cord 352, as shown in FIG. 5D, the tension 61 is transmitted to the second tie ring 372, bringing the second tie ring 372 to exert an additional binding force 62 toward the binding space 50 and more securely tighten around the air hose 20.

Figure 6A:
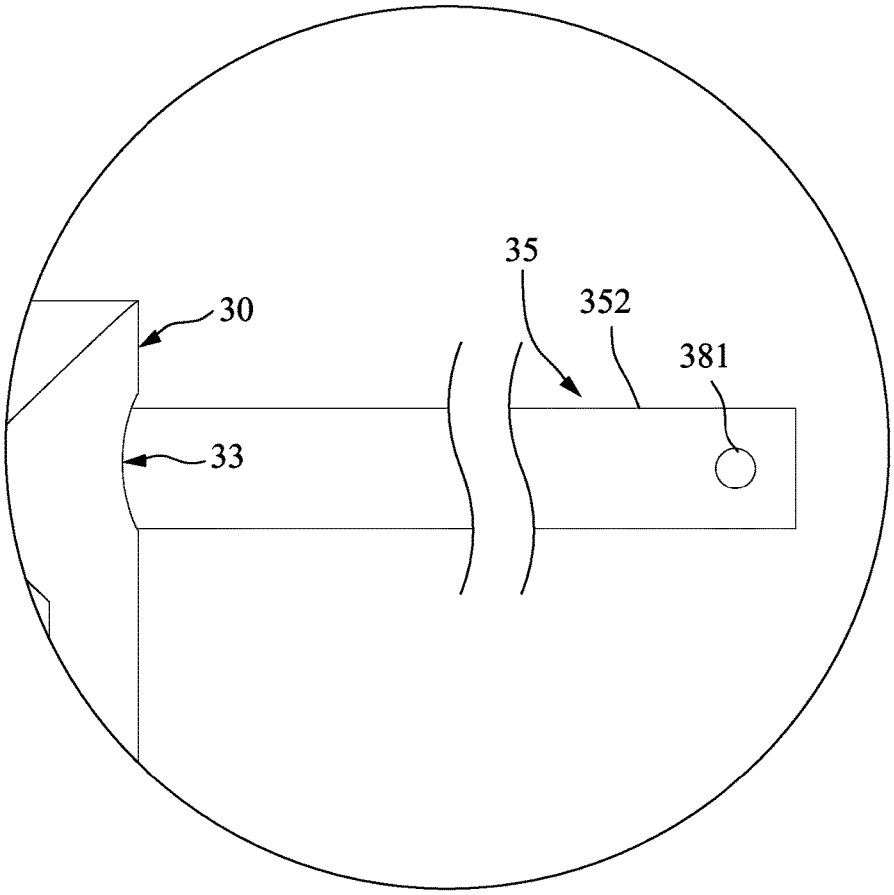
FIG. 6A shows a limiting member of the inflatable stretcher according to a fourth embodiment of the present invention.
Figure 6B:
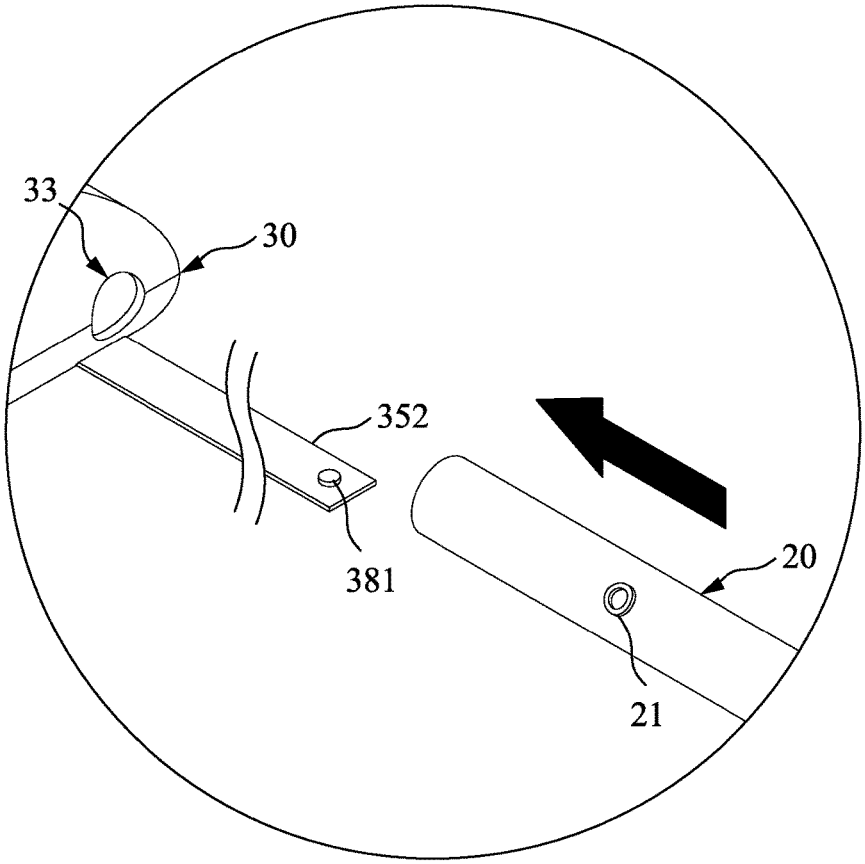
FIG. 6B shows the limiting member of FIG. 6A is ready for connecting the air mattress to the air hose.
Figure 6C:
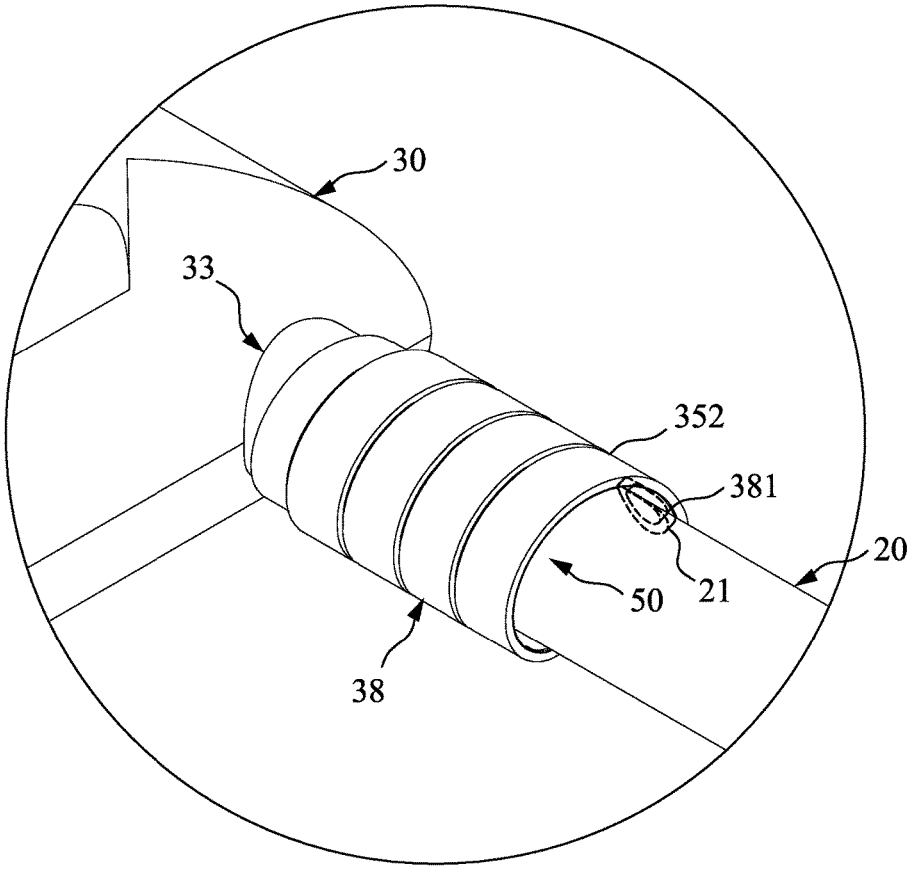
FIG. 6C shows the air mattress has been connected to the air hose via the limiting member of FIG. 6A and the limiting member is now in an initial position.
Figure 6D:
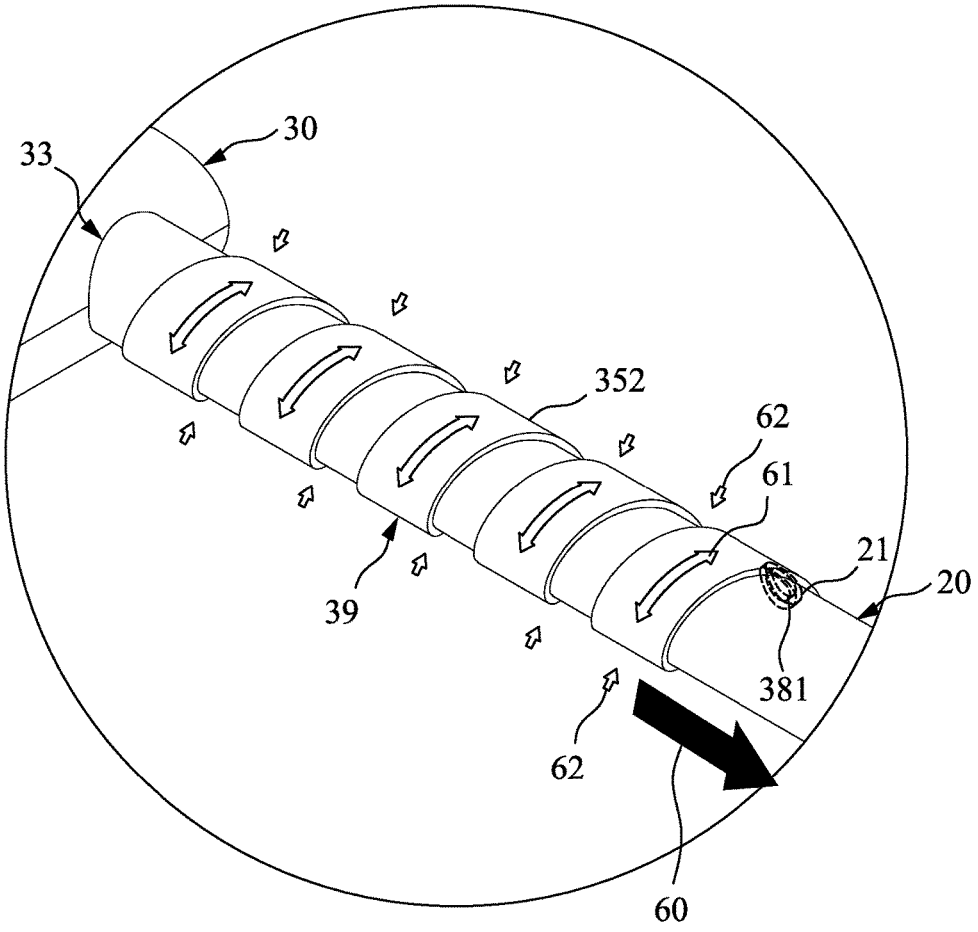
FIG. 6D shows a change in the tension of the limiting member of FIG. 6C when the air mattress is moved relative to the air hose.
Figure 7A:
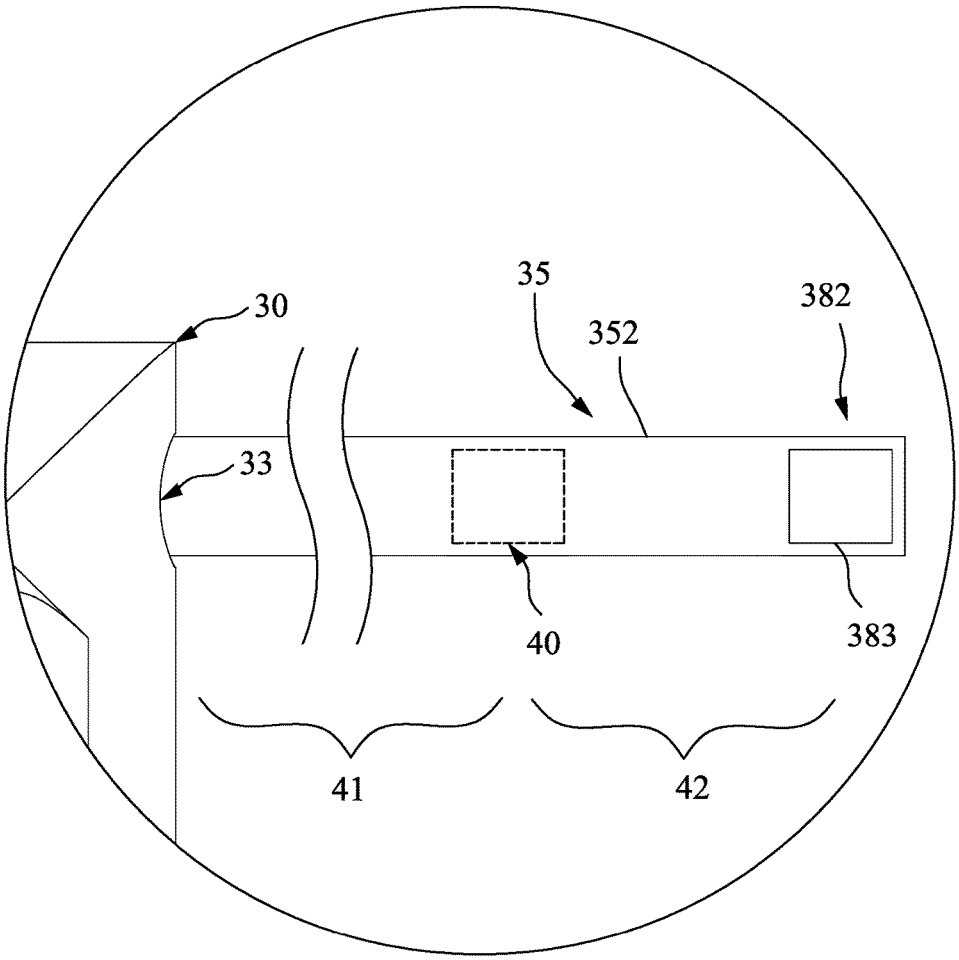
FIG. 7A shows a limiting member of the inflatable stretcher according to a fifth embodiment of the present invention.
Figure 7B:
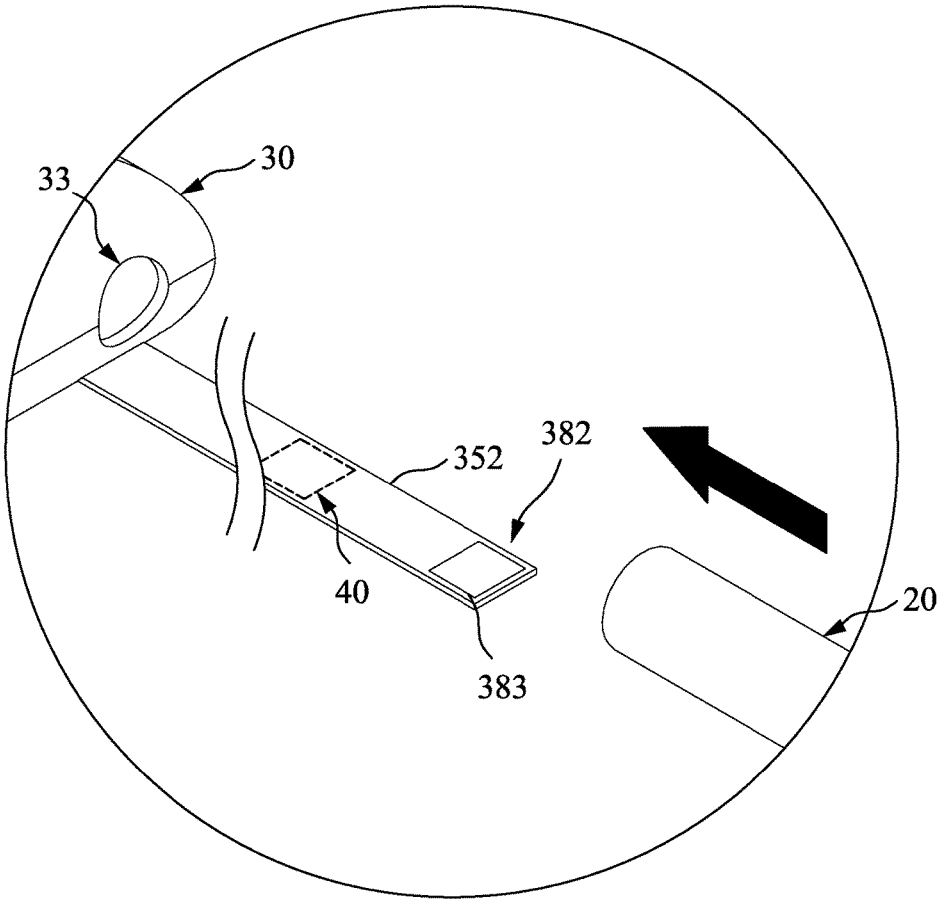
FIG. 7B shows the limiting member of FIG. 7A is ready for connecting the air mattress to the air hose.
Figure 7C:
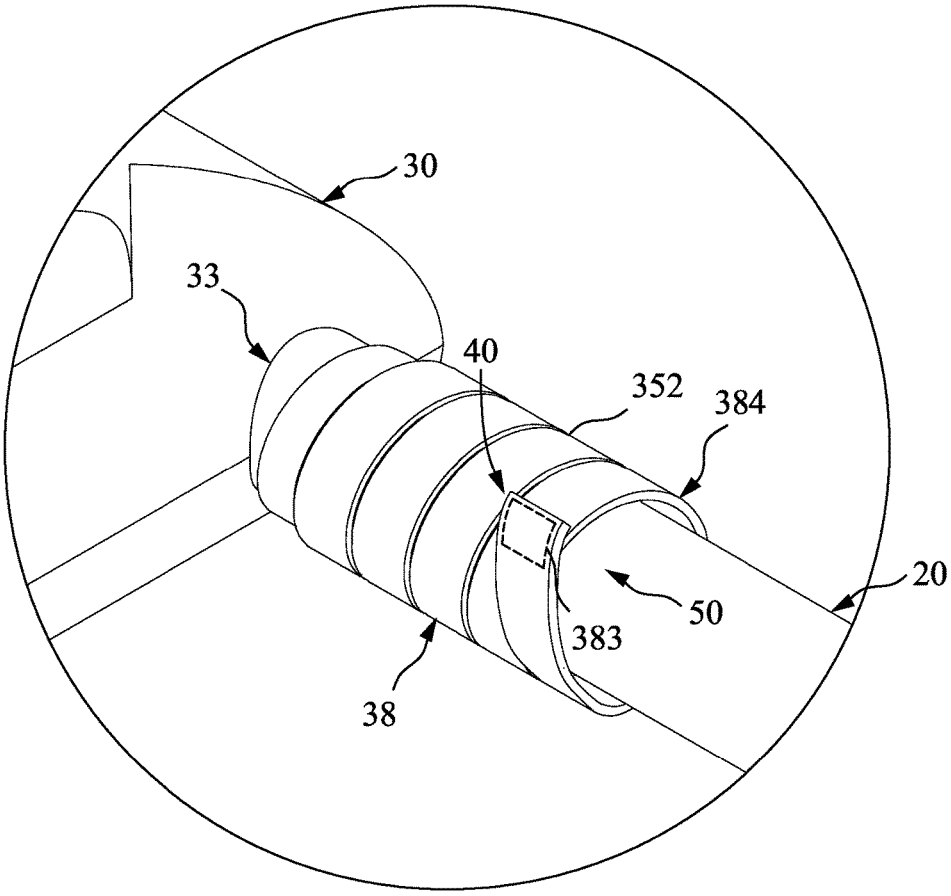
FIG. 7C shows the air mattress has been connected to the air hose via the limiting member of FIG. 7A and the limiting member is now in an initial position.
Figure 7D:
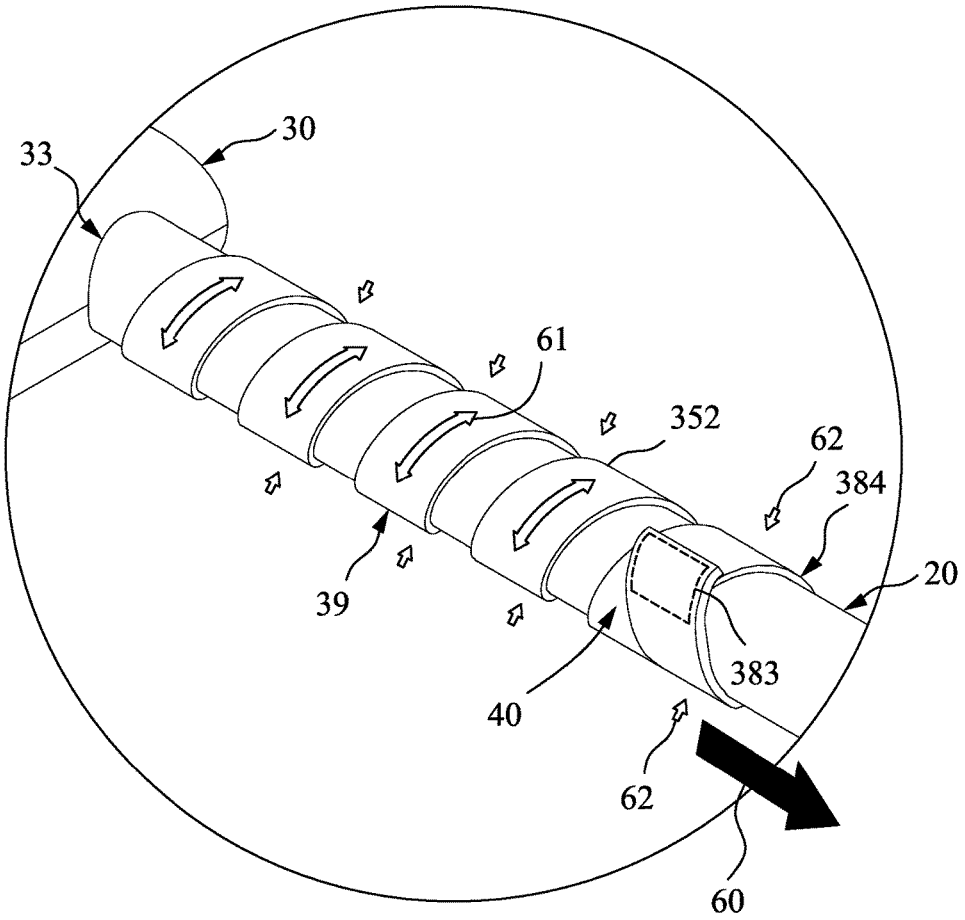
FIG. 7D shows a change in the tension of the limiting member of FIG. 7C when the air mattress is moved relative to the air hose.

Please refer to FIGS. 6A to 6D and to FIGS. 7A to 7D, in which the limiting member 35 of the inflatable stretcher according to a fourth and a fifth embodiment, respectively, of the present invention is shown. In the fourth and the fifth embodiment of the present invention, the limiting member 35 is configured as a belt 352. When the limiting member 35 is in an initial position as shown in FIGS. 6C and 7C, the belt 352 forms a tie ring structure 38, which defines the binding space 50. To enable convenient explanation of change in the shape of the tie ring structure 38 in these two embodiments, the limiting member 35 shown in FIGS. 6A to 6D and FIGS. 7A to 7D is not in real proportion to other elements in the figures. FIGS. 6D and 7D illustrate how the tie ring structure 38 changes the binding space 50 in a manner different from that in the third embodiment. When a relative movement 60 between the air hose 20 and the air mattress 30 occurs to cause an increased tension 61 in the belt 352, as shown in FIGS. 6D and 7D, a distal end of the belt 352 is moved farther away from the air mattress 30 due to the relative movement 60. At this point, the tie ring structure 38 is extended in length corresponding to a distance of the relative movement 60 and an overall length of the belt 352 to form a helical structure 39, which looks like a coil spring and is wound around the air hose 20. Again, to enable convenient explanation of the present invention, the change in the shape and length of the tie ring structure 38 shown in FIGS. 6A to 7D is not in real proportion to other elements in the figures. Similar to the case in the third embodiment, when the belt 352 in the fourth and the fifth embodiment of the present invention has an increased tension 61 due to the relative movement 60 between the air mattress 30 and the air hose 20, the helical structure 39 also exerts an additional binding force 62 toward the binding space 50 defined by it, preventing the air hose 20 from easily sliding relative to the limiting member 35.

Please refer to FIGS. 6A and 6B, which illustrate how to make the distal end of the belt 352 according to the fourth embodiment of the present invention move along with the relative movement 60. As shown, the belt 352 has a proximal end connected to the air mattress 30 and a distal end provided with a male fastener, which serves as a holding member 381; and the air hose 20 has a fixing end 21 provided with a female fastener, to which the male fastener is fastened. In the present invention, the holding member 381 is not particularly limited to any specific type, and the fixing end 21 of the air hose 20 is not necessarily provided with the female fastener. In an operable embodiment of the present invention, the holding member 381 can be a bonding sheet for directly attaching to the fixing end 21.

Please refer to FIGS. 7A and 7B. The belt 352 according to the fifth embodiment of the present invention has a proximal end connected to the air mattress 30 and a distal end forming a connecting section 382, at where a hook strip or a loop strip 383 of hook and loop fasteners is provided for attaching to a specific position 40 on the belt 352. The specific position 40 shown in FIG. 7A is determined corresponding to the size of the air hose 20. The location of the specific position 40 on the belt 352 can be adjusted according to an exact size of the air hose 20. Using the specific position 40 as a center, areas of the belt 352 located at two opposite lateral sides of the specific position 40 are defined as a first section 41 and a second section 42. As shown in FIG. 7C, in the fifth embodiment of the present invention, to connect the belt 352 to the air hose 20, first wind the first section 41 around the air hose 20 to form the tie ring structure 38, which can form the helical structure 39 when the relative movement 60 between the air mattress 30 and the air hose 20 occurs, as shown in FIG. 7D, and then wind the second section 42 around the air hose 20 to form a locating ring 384 that is in contact with the outer surface of the air hose 20. With these arrangements, the belt 352 being pulled to extend in length would not slide relative to the air hose 20.

In the present invention, the connection of the connecting section 382 to the specific position 40 on the belt 352 is not particularly limited to any specific manner. In an operable embodiment of the present invention, the connecting section 382 can be provided with a ferrule 371 similar to that used in the third embodiment. The belt 352 is extended through the ferrule 371 to form the locating ring 384. Or, the connecting section 382 can be further provided with other conventional connecting elements. Also, in the present invention, there is not any particular limitation to the relationship between the first section 41 and the second section 42 in terms of their lengths. In an operable embodiment of the present invention, the first section 41 has a length smaller than that of the second section 42. But in other operable embodiments of the present invention, the first section 41 can have a length larger than or equal to that of the second section 42.

In some operable embodiments of the present invention, the inflatable stretcher can combine the features of the above-described embodiments. For example, in an embodiment of the present invention that combines the first with the fifth embodiment (or with any other embodiment), the air mattress 30 can include both of the elastic ring 351 and the belt 352, and the elastic ring 351 is also connected to the belt 352. When the tension 61 in the cord/belt 352 is increased, the cord/belt 352 serving as a holding member also transmits the binding force 62 to the elastic ring 351, which serves as an airtight member, to not only further strengthen the connection of the elastic ring 351 to the air hose 20, but also enhance the airtight connection between the air mattress 30 and the air hose 20. On the other hand, in another embodiment of the present invention that combines the fourth and the fifth embodiment, the belt 352 can be provided at the connecting section 382 with both of the hook strip or the loop strip 383 and the holding member 381. For example, the holding member 381 can be disposed at a point between the specific position 40 and the connecting section 382, so that the air hose 20 can be selectively connected to the air mattress 30 in any one of the manners provided according to the fourth and the fifth embodiment of the present invention.

According to the present invention, the cord/belt 352 is not particularly limited to any specific type or material in design. In some operable embodiments, the cord/belt 352 can be made of a tensile material; but in some other operable embodiments, the cord/belt 352 can be made of a non-tensile material. The cord/belt 352 can be simply a thin and long tie string, or a flat tie strip providing an increased contact surface with the air hose 20 to avoid sliding relative to the air hose 20. In an operable embodiment of the present invention, the cord/belt 352 can be provided on one side attached to the air hose 20 with an element, such as a rubber pad, to enable an increased coefficient of friction between the air hose 20 and the cord/belt 352.

Also, according to the present invention, the air hose 20 is not particularly limited to any specific design. In some operable embodiments, the air hose 20 can be provided on its outer wall surface with a groove, around which the limiting member 35, such as the elastic ring 351 or the cord/belt 352, is directly wound. And, the limiting member 35 can be firmly connected to the air hose 20 not only by taking advantage of a frictional force between them, but also by other ways, such as snap-fitting.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An inflatable stretcher inflated via an air hose for carrying a patient thereon and conveniently transferring the patient to another patient carrying or transporting device, the inflatable stretcher comprising:

an inflatable mattress having an upper sheet member and a lower sheet member, which are fixedly connected to each other along their peripheral edges to form an inflatable air bag;

the air mattress being provided with at least one air inlet, via which the air hose is communicably connected to the air bag; and the lower sheet member arranged lengthwise; wherein the air mattress includes at least one limiting member located in the vicinity of the air inlet; the limiting member being able to define a binding space, which is changeable in size to correspond to a size of the air hose, such that the limiting member can always fitly set or wrapped around an outer surface of the air hose, the limiting member is configured as a belt, which is outward extended from the air mattress in a direction in which the air inlet is oriented; the belt in an initial position being wound around the air hose to form a tie ring structure; a distal end of the belt being movable farther away from the air mattress when a relative movement occurred between the air mattress and the air hose causing an increased tension of the belt, bringing the tie ring structure to extend in length corresponding to a distance of the relative movement and an overall length of the belt to thereby form a helical structure.

2. The inflatable stretcher as claimed in claim 1, wherein the belt has a proximal end connected to the air mattress and is provided at the distal end with a holding member; and the holding member being connected to a fixing end of the air hose.

3. The inflatable stretcher as claimed in claim 1, wherein the belt has a proximal end connected to the air mattress and is provided at the distal end with a connecting section, which is connected to a specific position on the belt; areas of the belt located at two opposite lateral sides of the specific position being defined as a first section and a second section; and the second section being wound around the air hose to form a locating ring that is in contact with the outer surface of the air hose.

4. The inflatable stretcher as claimed in claim 3, wherein the first section has a length smaller than that of the second section.

* * * * *